US005609515A

United States Patent [19]

Takach

[11] Patent Number: 5,609,515

[45] Date of Patent: Mar. 11, 1997

[54] HAND-HELD RECIPROCATING DEVICE WITH AN IMPROVED TOOL GUIDE SYSTEM

[76] Inventor: Thomas G. Takach, 7N061 Canterbury Ct., St. Charles, Ill. 60175

[21] Appl. No.: 344,071

[22] Filed: Nov. 23, 1994

[51] Int. Cl.[6] ..... B24B 23/00

[52] U.S. Cl. ..... 451/344; 454/356; 454/162; 454/166

[58] Field of Search ..... 457/162, 164, 457/344, 356; 173/170, 216; 229/19.6, 19.7

[56] References Cited

U.S. PATENT DOCUMENTS

| | | | |
|---|---|---|---|
| 2,690,081 | 9/1954 | Bjorklund et al. | 77/44 |
| 2,966,178 | 12/1960 | Katzfey | 143/68 |
| 3,007,230 | 11/1961 | Riedl | 29/76 |
| 3,095,748 | 7/1963 | Stelljes et al. | 74/44 |
| 3,626,768 | 12/1971 | Dancsik | 74/44 |
| 4,233,850 | 11/1980 | Edwardson | 74/44 |
| 4,512,207 | 4/1985 | Dancsik | 74/44 |
| 5,212,995 | 5/1993 | Robinson et al. | 74/44 |

OTHER PUBLICATIONS

"Engis FMA D–Profiler Parts Price List," printed in the United States prior to Jul. 1, 1990, by Engis Corporation.

*Primary Examiner*—Bruce M. Kisliuk
*Assistant Examiner*—George Nguyen
*Attorney, Agent, or Firm*—Fitch, Even, Tabin & Flannery

[57] ABSTRACT

In accordance with the present invention, there is provided a profiler device having a linear drive mechanism with enhanced tool holder support to effectively guide the substantially linear reciprocating movement of the tool holder so to maintain accuracy during machining operations and to extend the life of the tool and the device. The linear drive mechanism includes a reciprocating sleeve guided for substantially linear movement in a main guide sleeve, which is fixed to a profiler housing. The main guide sleeve includes a square socket formed in one end for receiving a square end of the tool holder. The surfaces of the square socket and the square end slidably engage one another for guiding and supporting the tool holder. The square end of the tool holder also includes a central bore which receives with a friction fit one end of reciprocating sleeve for being driven linearly with the reciprocating sleeve. The main guide sleeve, reciprocating sleeve and tool holder may be made from predetermined materials which are capable of self-lubricating for being resistant to wear and which are of a particular hardness.

21 Claims, 4 Drawing Sheets

HAND-HELD RECIPROCATING DEVICE WITH AN IMPROVED TOOL GUIDE SYSTEM

FIELD OF THE INVENTION

The present invention relates to a powered hand-held reciprocating device whose output reciprocates a tool attachment and, more particularly, to a hand-held reciprocating device whose tool holder for the tool attachment is guided by an improved guide system for extending both the life of the device and the tool attachments and for enhancing machining operations.

BACKGROUND OF THE INVENTION

When machined or cast articles, such as dies, molds and the like, are initially manufactured, it is common for them to have moderate to poor surface finishes. In many instances, it is essential that these articles be prepared with a superior surface finish not having any surface defects. Any such surface defects would otherwise adversely affect the molded or casted product. These defects must be polished out or removed with a high degree of precision and without improperly changing the overall surface contour. For instance, it may require finishing the surface containers of the work piece to within one or two thousandths of an inch, or less, of the established specifications for the work piece. In other applications, mold making errors or structural defects must be corrected to ensure the work piece complies to exacting tolerances and clearances.

An abrasive tool is typically used to remove such defects or make such changes to a work piece. These abrasive tools can be made of a variety of materials, and include abrasive "stones." Such "stones" typically are compressed abrasive materials with a controlled surface texture with a certain abrasive grade based on the size of abrasive particles at the tool surface. These stones frequently must be handled with care to prevent breakage or cracking of the stone surface on the stone itself. In addition, the abrasive tool must be applied to the work piece surface with particular care because any imprecise or unpredictable tool motion can ruin the work piece mold or require additional cost to repair the damaged surface.

Power hand tools, generally referred to as profilers, are commonly used to assist in polishing and removing such surface defects and making surface changes. These profilers provide reciprocating movement to operate a suitable abrasive tool attachment. The reciprocating tool attachment is then directed at the surface areas of the article to remove unwanted surface material. As mentioned above, a profiler must effectively support the tool attachment to prevent it from wobbling; otherwise, the tool attachment may break or gouge the surface of the article.

In many profilers, the reciprocating movement for the tool attachment is derived from a drive rod following an off-centered rotating tuner mechanism. The drive rod then drives a linear drive mechanism having a tool holder for the tool attachment. The tuner mechanism is driven by an external source, such as a remote hydraulic or electric powered unit, preferably being equipped with a speed control unit which allows the profiler's speed to be adjusted according to the finishing process used and the tool attachment's requirements. Though capabilities vary from one profiler design to another, these tuner mechanisms are known to rotate at speeds in excess of 22,000 rpms or more, while speeds up to 5,000 rpms are most common. As a result, the drive rod is capable of driving the linear drive mechanism at significant speeds. Therefore, the linear drive mechanism must effectively support and guide the tool holder in a manner which is resistant to unnecessary component wear caused by significant speed operation so that the tool attachment reciprocates linearly in a single plane and, hence, is not allowed to wobble.

It is common for the linear drive mechanism to have components with engaging surfaces sliding over one another to precisely guide the linear reciprocating movement of the tool holder. These surfaces prevent the tool attachment from wobbling outside of the desired path of reciprocating movement. However, during operation, machining loads act on the tool holder from directions outside the desired path of reciprocating movement. Experience has revealed that these loads cause the engaging surfaces of the components to wear and rapidly lose proper engagement. As a result, the tool holder tends to wobble outside the desired path of reciprocating movement, which causes a decrease in the accuracy and precision that can be obtained with the abrasive tool. Any such decrease in accuracy may result in polishing or removal errors. Additionally, errors resulting from operator fatigue will increase because polishing and removal operations will take longer when attempting to compensate for the wobbling of the tool attachment.

Further, restoring the accuracy of the profiler becomes expensive as the life of profiler components decreases. To restore the profiler's accuracy, the components having the engaging surfaces must be replaced to reestablish the proper surface engagement necessary for precisely guiding the reciprocating movement of the tool holder. Often such replacement parts are not available and the entire profiler must be replaced. In addition to the cost of replacement pans and new profilers, the downtime associated with replacing pans and profilers also contributes significantly to the overall cost of machining operations.

Therefore, there is a desire for a profiler device that provides enhanced support for the tool holder to effectively accommodate machining loads outside the path of reciprocating movement for sustaining the accuracy and precision of the profiles and for reducing the expense associated with unnecessary downtime and replacement pans.

One known example for guiding a profiler's tool holder includes a tool support housing having a slot formed in its remote end that is in sliding engagement with a pair of opposed flats extending from a tool holder. This sliding engagement guides the reciprocating movement of the tool holder. Further, the tool holder is driven by a sleeve having a sliding surface engagement with a support housing which also aids in guiding the reciprocating movement of the tool holder.

One known shortcoming with this device is its inability to adequately support the tool holder for effectively accommodating machining loads outside the path of reciprocating movement. During machining operations, these machining loads cause the flats of the tool holder to wear the edges of the slots so that they become enlarged. This allows the tool holder and the tool to wobble. Also, other components, such as the reciprocating sleeve and the support housing, are found to wear more rapidly when the tool holder wobbles. These adverse effects contribute significantly to requiring the profiler components, including the tool, to be replaced more often than desired for maintaining machining accuracy.

An object of the present invention is to provide an improved guide system for the tool holder that advantageously extends the life of the tool and profiler components for maintaining accuracy and reducing machining costs.

Another object of the present invention is to provide a guide system in which the surface engagement used to guide the tool holder is increased to yield improved support against machining loads.

An even further object of the present invention is to provide a guide system that is more resistant to wear caused by machining loads.

An overall object of the present invention is to provide an improved guide system having all the above-mentioned objects which is highly durable, efficient and cost effective to manufacture, install and operate.

Other objects of the invention are discussed below and are shown in the figures.

Summary of the Invention

In accordance with the present invention, there is provided a hand-held reciprocating device with an improved system for supporting and guiding a tool holder to ensure that it precisely reciprocates a tool attachment used for polishing and adjusting the interior surfaces of dies, molds and the like. When the tool attachment engages the surface for polishing, machining loads from directions outside a desired path of reciprocating movement for the tool attachment are applied to the tool holder. The device of the present invention accommodates such machining loads to prevent the tool holder from wobbling. This reduces errors on the surface of the article and reduces the potential for the tool to break or the components of the device to wear. As a result, the costs associated with polishing and removal errors, replacement parts and downtime, are decreased.

The hand-held reciprocating device of the present invention may comprise a housing defining an internal cavity and having a bore that extends out of the housing from the internal cavity. A drive mechanism may be located in the cavity of the housing for providing reciprocating movement. An outer guide sleeve may be mounted to the housing. The outer guide sleeve may define a bore extending between a first inner end for mounting to the housing and a second opposing outer end. The bore of the outer guide sleeve may be aligned with the bore of the housing and may have a plurality of contiguous inner surfaces defining it at the outer end.

An inner reciprocating sleeve may be located in the bore of the outer guide sleeve intermediate the inner end and the outer end for linear reciprocating movement in the outer guide sleeve. The inner reciprocating sleeve may have a first end coupled to the drive mechanism and a second end located adjacent the outer end of the outer guide sleeve. A connector may extend from the cavity through the bore in the housing for coupling the first end of the inner reciprocating sleeve to the drive mechanism.

A tool holder, being capable of holding the tool, may be coupled to the second end of the inner reciprocating sleeve for movement with the inner reciprocating sleeve. The tool holder may further have a plurality of contiguous outer surfaces which each may be in sliding engagement with one of the contiguous inner surfaces at the outer end of the outer guide sleeve for guiding the linear reciprocating movement of the tool holder.

The bore of the outer guide sleeve may have a larger transverse cross-sectional area at its outer end than at its inner end. Also, the contiguous outer surfaces of the tool holder may be substantially planar surfaces, and the contiguous inner surfaces defining the bore at the outer end of the outer guide sleeve may be substantially planar surfaces. Each of the substantially planar surfaces of the tool holder then may be in sliding engagement with one of the substantially planar surfaces at the outer end of the outer guide sleeve. These engaging planar surfaces guide the linear reciprocating movement of the tool holder. The intersection between adjacent surfaces of the substantially planar surfaces of the tool holder and the outer guide sleeve may be slightly rounded.

At least two of the adjacent surfaces of the contiguous outer surfaces of the tool holder may be substantially perpendicular to one another, and at least two of the adjacent surfaces of the contiguous inner surfaces at the outer end of the outer guide sleeve may be substantially perpendicular to one another. The perpendicular surfaces of the tool holder may engage the perpendicular surfaces of the outer guide sleeve to guide the linear reciprocating movement of the tool holder.

The outer guide sleeve may be made from a metal material capable of self-lubrication to resistant wear. For instance, the outer guide sleeve may be made from an oil hardened metal material which is nitrided to have an approximate hardness of at least Rockwell 70. The tool holder may be made from a metal material having an approximate hardness of at least Rockwell 56–58, and the inner reciprocating sleeve may be made from an oil hardened metal material having an approximate hardness of at least Rockwell 60–62.

DETAILED DESCRIPTION OF THE DRAWINGS

The present invention will be described in connection with the accompanying drawings, which illustrate the preferred embodiments and details of the invention, and in which.

DETAILED DESCRIPTION OF THE PREFERRED EMBODIMENT

Figure 1:
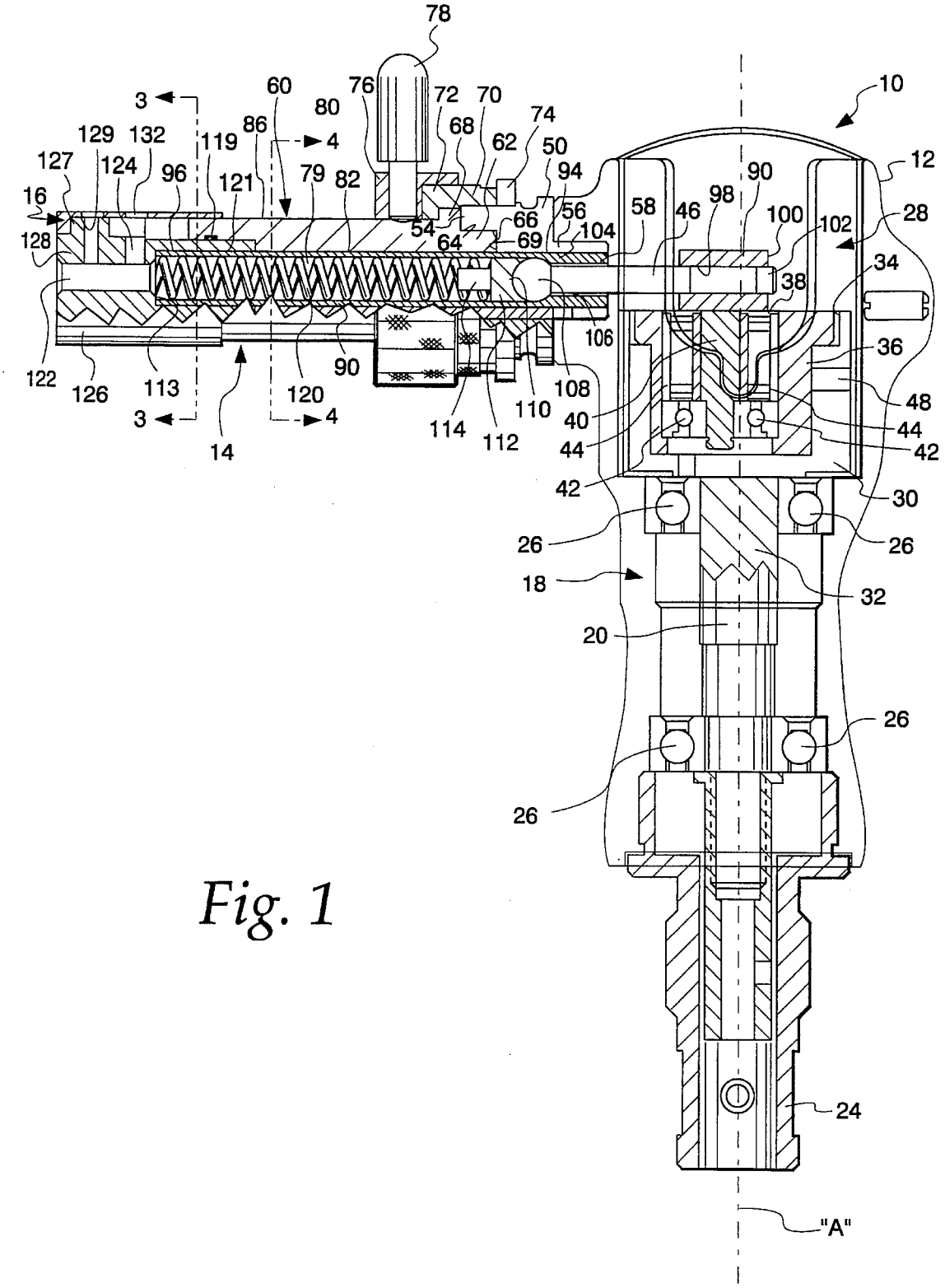
FIG. 1 is a cross-sectional side view of a hand-held reciprocating device embodying the present invention.

Referring to FIG. 1 of the drawings, there is illustrated one example of a hand-held reciprocating device embodying the present invention in the form of a profiler 10 used for operating a tool attachment (not shown) to polish and remove portions of the interior surfaces of articles, such as dies, molds and the like (not shown). The profiler 10 includes a housing 12 in which there is mounted a rotary drive mechanism 18 with a drive shaft 20 rotating on a vertical axis, indicated by reference character "A". A linear drive mechanism 14 is mounted externally to the housing 12 for linearly reciprocating a tool holder 16 in a direction substantially perpendicular to the rotational axis "A" for the drive shaft 20. A stroke tuner mechanism 28 is mounted to the drive shaft 20 in the housing 12 for converting the rotary motion of the rotary drive mechanism 18 to linear motion to drive the linear drive mechanism 14 for linearly reciprocating the tool holder 16.

As best illustrated in FIG. 1, an external source (not shown) rotates the drive shaft 20 which in turn rotates the stroke tuner mechanism 28. A connecting rod 46 operatively communicates with the stroke tuner mechanism 28 to convert the rotary motion of the stroke tuner mechanism 28 to a linear motion. The connecting rod 46 further is operatively connected with the linear drive mechanism 14 to reciprocate with the linear motion of the connecting rod 46, the tool holder 16. The tool holder 16 is capable of holding a tool attachment (not shown) so that it also reciprocates with the tool holder 16. During machining operations, the tool attachment is applied to the article for polishing and shaping its interior surfaces. Thus, it is important that the linear drive mechanism 14 precisely guide the tool holder 16 for accurate machining and to adequately support the tool holder 16 for accommodating loads applied to the tool attachment from directions other than the desired direction of linear reciprocating movement.

More specifically, the housing 12 includes a lower end 24 adapted to communicate with a suitable drive cable (not shown) driven by an external source (not shown) for rotating the drive shaft 20. Two sets of axially spaced bearings 26 support the drive shaft 20 in the housing 12. The stroke tuner mechanism 28 includes an outer plug 30 mounted to the drive shaft 20 at its upper end 32 for rotating with the drive shaft 20. The outer plug 30 defines an eccentric bore 34 in which sits an inner plug 36. The inner plug 36 defines an eccentric bore 38 in which the stroke tuner shaft 40 is mounted for rotation upon a set of bearings 42 and is spaced laterally for rotation by sleeve bearings 44.

The stroke tuner shaft 40 rotates off-center from the rotational axis "A" for the drive shaft 20 and is followed by the connecting rod 46 to convert the rotary motion to linear reciprocating motion. The outer plug 30 and the inner plug 36 are capable of being rotated relative to one another for selectively adjusting the amount of off-center rotation for the stroke tuner shaft 40 in order to manipulate the stroke of the connecting rod 46. Once the desired stroke is set, a lock screw 48 may be used to lock the position of the inner and outer plugs 30 and 36.

Figure 2:
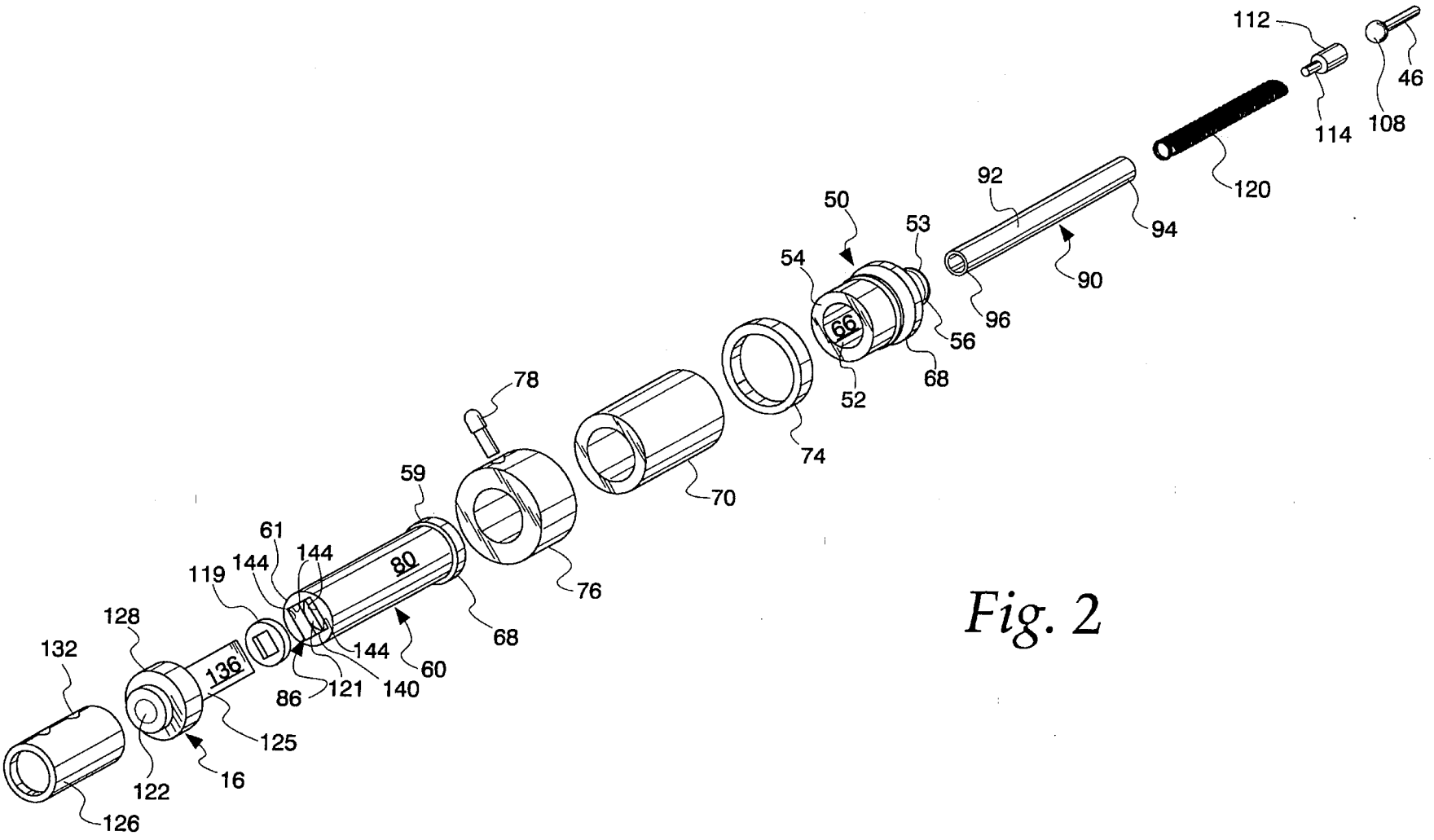
FIG. 2 is a cross-sectional view of the hand-held reciprocating device taken along line 2—2 of FIG. 1.

As best illustrated in FIGS. 1 and 2, a support bushing 50 mounts the linear drive mechanism 14 to the housing 12. The support bushing 50 includes an inner end 53 for mounting the support bushing 50 to the housing 12 and an opposing outer end 54 for :mounting the linear drive mechanism 14. The support bushing 50 further defines a central bore 52 extending between the inner end 53 and the outer end 54 of the support bushing. The support bushing 50 also includes a collar 56 at the inner end 53 which has external threads about its exterior surface. The central bore 52 extends through the collar 56 and has a larger diameter at the outer end 54 than at the collar 56.

As best illustrated in FIG. 1, the housing 12 defines a bore 58 which has an interior surface with threads. The collar 56 of the support bushing 50 may be rotated into the bore 58 so that the threads of the bore 58 cooperatively engage the threads of the collar 56 for mounting the support bushing 50 to the housing 12. With the support bushing 50 mounted to the housing 12, the bore 58 of the housing 12 and the central bore 52 of the support bushing 50 are aligned to define a passage between the stroke tuner mechanism 28 in the housing 12 and the linear drive mechanism 14. To couple the stroke tuner mechanism 28 to the linear drive mechanism 14, the connecting rod 46 extends out of the housing 12 into the linear drive mechanism 14 through the passage defined by the bore 58 in the housing 12 and the central bore 52 of the support bushing 50.

As best illustrated in FIGS. 1 and 2, the linear drive mechanism 14 includes a main guide sleeve 60 which supports the tool holder 16 and guides it for linear reciprocating movement in a direction substantially normal to the axis "A" of rotation for the drive shaft 20 of the rotary mechanism 18. The main guide sleeve 60 includes an inner end 59 (FIG. 2), adapted to mount the outer main guide sleeve 60 to the support bushing 50 and an opposing outer end 61 (FIG. 2) adapted to support and guide the tool holder 16.

More specifically, the inner end 59 of the outer main guide sleeve 60 includes a collar 62 (FIG. 5), having an outer diameter less than that of the outer main guide sleeve 60. To mount the outer main guide sleeve 60, the collar 62 is inserted into the central bore 52 at the outer end 54 of the support bushing 50. When inserted, an exterior surface 64 (FIG. 5) of the collar 62 engages an interior surface 66 (FIG. 2) of the support bushing 50, which defines the central bore 52 at the outer end 54. The engaged surfaces 64 and 66 are capable of sliding over one another to allow the outer guide sleeve 60 to be rotated in the support bushing 50 for adjustment.

Figure 5:
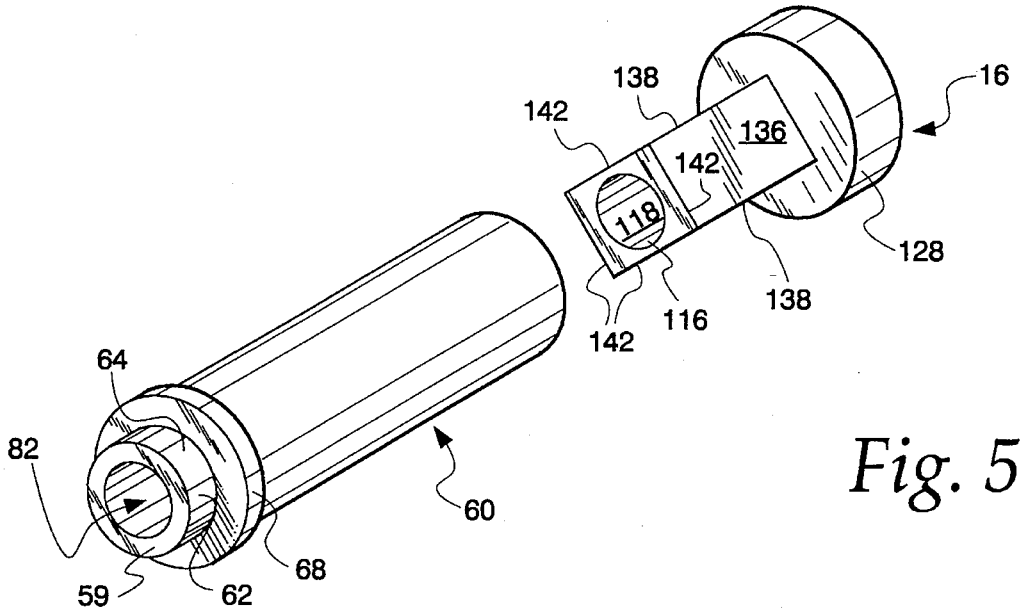
FIG. 5 is a perspective view of the tool holder and guide sleeve of the hand-held reciprocating device of FIG. 1.

The main guide sleeve 60 also includes an annular flange 68 which is used to guide and maintain the main guide sleeve 60 in the central bore 52 of the support bushing 50. The annular flange 68 extends radially from the main guide sleeve 60 at a predetermined distance from the inner end 59. This predetermined distance may be equal to the length of the collar 56 (FIG. 5). Also, the predetermined distance may correspond to the depth of the portion of the central bore 52 at the outer end 54 having the enlarged interior diameter (FIG. 1 ). In this situation, the collar 56 abuts a bottom rim 69 (FIG. 1 ), which partially defines the central bore 52 of the support bushing 50 at the outer end 54, to prevent insertion into the central bore 52. The flange 68 may also engage the outer end 54 of the support bushing 50 to prevent insertion into the central bore 52.

To lock the main guide sleeve 60 in the central bore 52 of the support bushing 50, an annular guide support nut 70 includes an annular hook portion 72 which clamps the flange 68 of the main guide sleeve 60 against the outer end 54 of the support bushing 50. More specifically, the annular guide support nut 70 includes external threads (not shown) to cooperate with an annular lock nut 74 having complementary threads (not shown). As the annular lock nut 74 is turned for tightening, the guide support nut 70 draws the collar 64 of the main guide sleeve 60 into the central bore 52 of the support bushing 50. Once the annular lock nut 74 is tightened, the hook portion 72 of the annular guide support nut 70 clamps the annular flange 68 against the outer end 54 of the support bushing 50 to prevent rotational and longitudinal movement of the main guide sleeve 60 relative to the support bushing 50.

When the annular lock nut 74 is loosened, the main guide sleeve 60 may be rotated to adjust the tool attachment. To assist in rotating the main guide sleeve 60, an annular tool guide retainer 76 may engage the main guide sleeve 60 adjacent the guide support nut 70. The tool guide retainer 76 may include a set screw 78 which is tightened to abut an outer surface 80 of the main guide sleeve 60 for securing the tool guide retainer 76 to the main guide sleeve 60. The tool guide retainer 76 and the set screw 78 may then be gripped to rotate the main guide sleeve 60.

As best illustrated in FIGS. 1–5, the main guide sleeve 60 defines a central bore 79 (FIG. 1) extending longitudinally between the inner end 59 and the outer end 61 of the main guide sleeve 60. The central bore 79 is segmented into an circular bore portion 82 (FIGS. 1 and 5) for guiding a reciprocating sleeve 90 and a square bore portion 86 (FIGS. 1 and 2), or socket, for guiding the tool holder 16. The circular bore portion 82 is defined by an inner surface 84 (FIG. 4) to have a circular cross-section taken perpendicular to the linear reciprocating direction of the reciprocating sleeve 90. The square bore portion 86 is defined by a four contiguous inner surfaces 88*a*, 88*b*, 88*c* and 88*d* (FIG. 3) to have a square cross-section taken perpendicular to the linear reciprocating direction of the tool holder 16. The square bore portion 86 may have a cross-sectional area larger than the circular bore portion 82.

Figure 4:
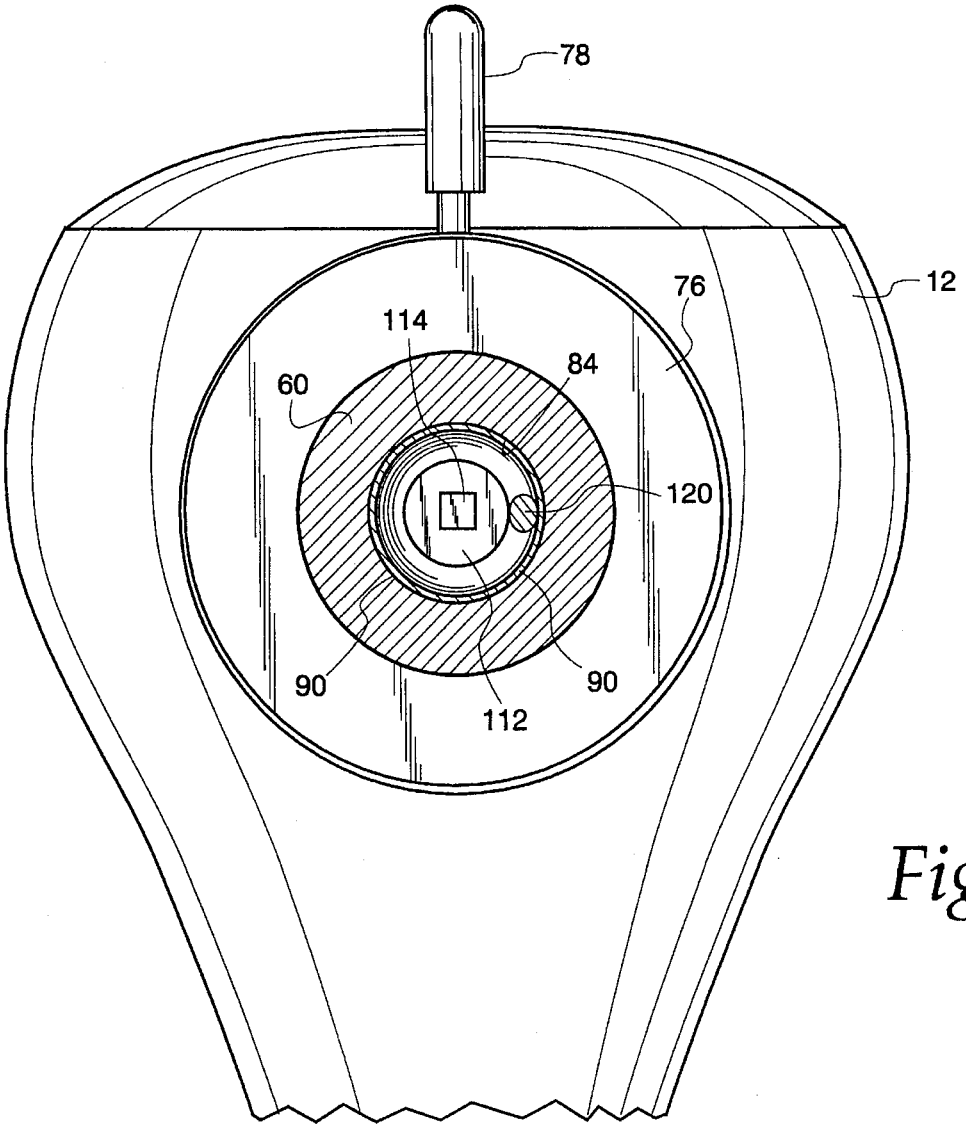
FIG. 4 is a cross-sectional view of the hand-held reciprocating device taken along line 4—4 of FIG. 1.

As best illustrated in FIGS. 1, 2 and 4, the reciprocating sleeve 90 is located in the central bore 79 (FIG. 1 ) of the main guide sleeve 60. For guiding the linear reciprocating movement, the reciprocating sleeve 90 includes an outer surface 92 (FIGS. 2 and 4) in sliding engagement with the inner surface 84 (FIG. 4) that defines the circular bore portion 82.

As best illustrated in FIGS. 1 and 2, the reciprocating sleeve 90 further includes an inner end 94 coupled to the connecting rod 46 and an opposing outer end 96 coupled to the tool holder 16. The connecting rod 46 drives the reciprocating sleeve 90 which in turn reciprocates the tool holder 16.

As best illustrated in FIG. 1, the connecting rod 46 is coupled to the stroke tuner shaft 40 for following the off-center rotation of the stroke tuner shaft 40. The stroke tuner shaft 40 defines a bore 98 that is centrally located adjacent an upper end 99 of the stroke tuner shaft 40. A first end 100 of the connecting rod 46 extends through the bore 98 of the stroke tuner shaft 40 with a friction tight fit so the first end 100 of the connecting rod 46 follows the movement of the stroke tuner shaft 40. Additionally, the first end 100 may also have threads (not shown) which cooperate with a nut 102 for securing it to the stroke tuner shaft 40.

As best illustrated in FIGS. 1 and 2, the connecting rod 46 is coupled to the inner end 94 of the reciprocating sleeve 90 in a manner that allows the connecting rod 46 to swivel as the connecting rod 46 follows the stroke tuner shaft 40. More specifically, the interior of the reciprocating sleeve 90 at the inner end 94 includes a first partially spherical annular socket 104 (FIG. 1) that defines an opening 106 (FIG. 1) extending out of the reciprocating sleeve 90. The connecting rod 46 extends through the opening 106 into the reciprocating sleeve 90. The opening 106 communicates with the interior of the reciprocating sleeve 90 and has a diameter sufficient to provide clearance for the connecting rod 46 to swivel during machining operations. The connecting rod 46 includes an opposing second end formed with a spherical ball 108 which sits in and engages the first partially spherical annular socket 104.

A plug 112 sits in the reciprocating sleeve 90 and includes a second partially spherical socket 110 (FIG. 1) that faces the first partially spherical socket 104 for engaging the ball 108 of the connecting rod 46. The first and second partially spherical sockets 104 and 110, respectively, snugly engage the ball 108 of the connecting rod 46 in a manner that allows the connecting rod 46 to swivel for following the stroke tuner shaft 40.

As best illustrated in FIGS. 1, 2 and 5, the outer end 96 of the reciprocating sleeve 90 is coupled to the tool holder 16 with a friction fit engagement that reciprocates the tool holder 16 with the reciprocating sleeve 90. More specifically, the tool holder 16 defines a bore 116 (FIG. 5) with a circular interior surface 118 (FIG. 5). The bore 116 is adapted to receive the outer end 96 of the connecting rod 90 with a friction fit between the outer surface 92 of the reciprocating sleeve 90 (FIG. 2) and the interior surface 118 (FIG. 5) of the bore 116 (FIG. 5).

As best illustrated in FIGS. 1 and 2, a spring 120 extends through the reciprocating sleeve 90 between the tool holder 16 and the plug 112 for absorbing excessive machining loads that may cause damage to the tool and the profiler 10. More specifically, the spring 120 extends between a spring seat 114, projecting from the plug 112 on the side opposite the second partially spherical socket 110, and an interior surface 113 (FIG. 1) that partially defines the bore 116 of the tool holder 16. The spring 120 biases the plug 112 toward the ball 108 to maintain the second socket 110 and the first socket 104 in engagement with the ball 108 for coupling the connecting rod 46 at the inner end 94 of the reciprocating sleeve 90.

During machining operations, the spring 120 limits the load that can be imposed upon the connecting rod 46. When a load exceeding the biasing force of the spring 120 is applied to the tool holder 16, the connecting rod 46 extends further into the reciprocating sleeve 90 because the spring 120 enables the plug 112 to slide toward the tool holder 16. This limits stalling of the external source and damage to the linear drive mechanism 14, the rotary drive mechanism 18 and the tool.

As best illustrated in FIGS. 1 and 2, the tool holder 16 defines a tool holding bore 122 adapted to receive a shank of a tool (not shown) for mounting the tool for reciprocating with the tool holder 16. The tool holder 16 also defines a vertically extending bore 124 (FIG. 1) that intersects the tool holding bore 122. The bore 124 is adapted to cooperate with a screw (not shown) to secure the tool in the tool holding bore 122. The screw is readily accessible for changing the tool in the tool holder 16.

As best illustrated in FIGS. 1 and 2, a tool holder cover 126, or shield, is mounted to the tool holder 16 for preventing the entry of chips and abrasive into the linear drive mechanism 14. More specifically, the tool holder 16 includes an annular flange 128 (FIG. 5) that engages an interior surface 129 (FIG. 1) of the cover 126 with a friction fit that enables the cover 126 to reciprocate with the tool holder 16. The cover 126 includes a rim 127 (FIG. 1) extending inward that engages the front of the flange 128. The cover 126 encompasses the tool holder 16 and extends toward the main guide sleeve 60 to have a sliding engagement with the outer surface 80 of the main guide sleeve 60 during machining operations. The cover 126 defines an opening 132 aligned with the bore 124 of the tool holder 16 to provide access to operate the screw for changing the tool in the tool holder 16.

Figure 3:
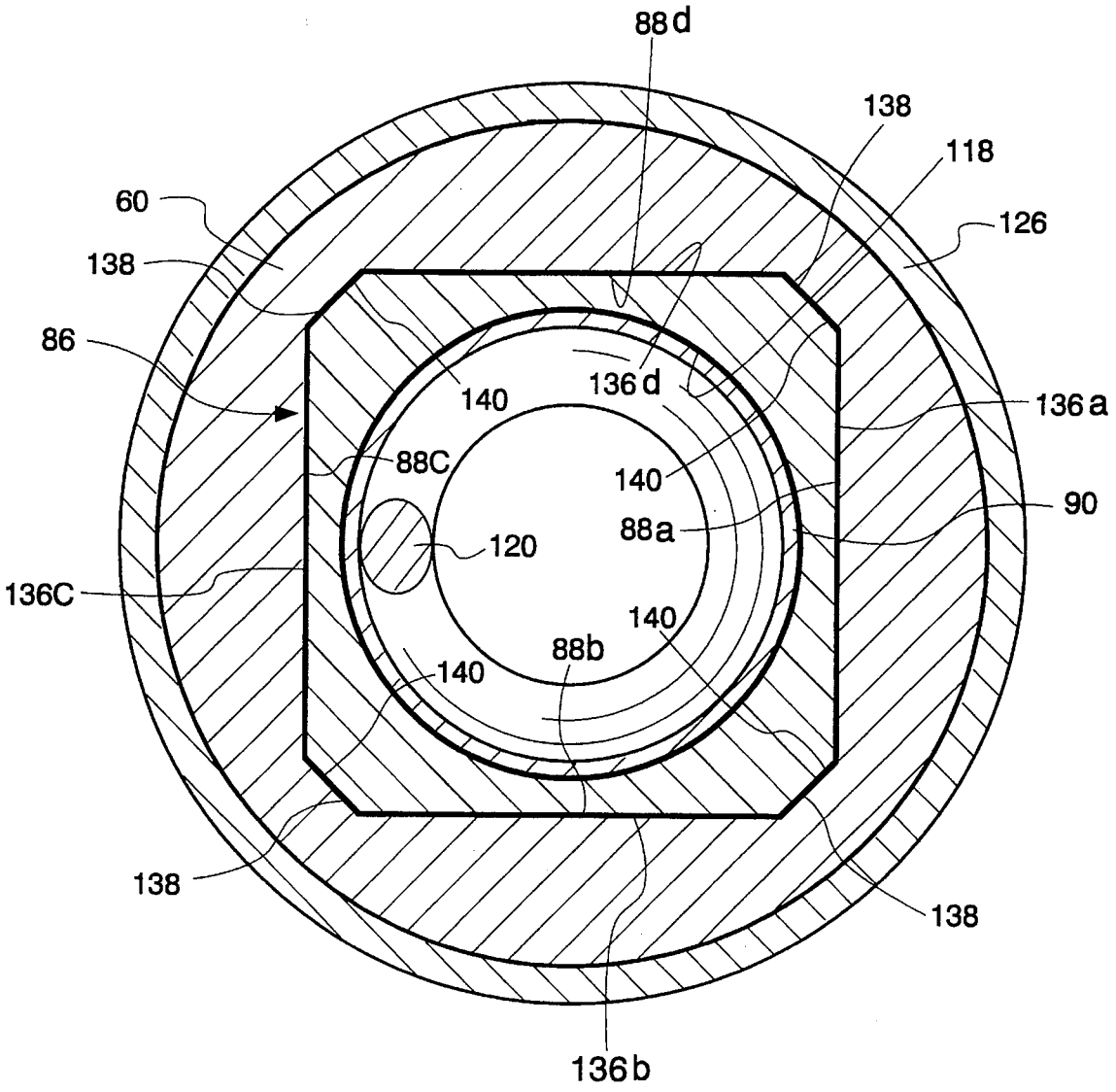
FIG. 3 is an exploded view of the linear drive mechanism of the hand-held reciprocating device of FIG. 1.

As best illustrated in FIGS. 1, 2, 3 and 5, the tool holder 16 is supported in the square portion 86 of the central bore 79 of the main guide sleeve 60 for guided linear reciprocating movement, which is substantially normal to the axis "A" of rotation for the drive shaft 20 of the rotary mechanism 18. More specifically, the tool holder 16 includes a square end 125 (FIG. 2) defined by four substantially contiguous and equal planar outer surfaces 136*a*, 136*b*, 136*c* and 136*d* (FIG. 3). The inner surfaces 88*a*, 88*b*, 88*c* and 88*d* (FIG. 3) that define the square portion 86 of the central bore 79 are also substantially contiguous and equal planar surfaces. Each of the outer surfaces 136*a*, 136*b*, 136*c* and 136*d* are in sliding engagement with one of the inner surfaces 88*a*, 88*b*, 88*c* and 88*d* (FIG. 3).

As a result of the above-described planar surfaces, the tool holder 16 is restricted to movement in a substantially linear direction only. Also, the surface area guiding the tool holder 16 is increased to more effectively distribute loads applied to the tool holder 16 during machining operations. More specifically, this enables the linear drive mechanism 14 to accommodate loads applied from directions other than the direction of linear reciprocating movement. As a consequence, the wearing of these engaging surfaces (88*a*, 88*b*, 88*c*, 88*d*, 136*a*, 136*b*, 136*c* and 136*d*), caused by such loads, is reduced in manner that prolongs the accuracy of the machining operations. That is, the tool holder does not wobble as often due to wearing of these engaging surfaces. Thus, machining accuracy is maintained, and the life of the linear drive mechanism 14 and the tool are extended.

It is also contemplated in accordance with the present invention that the tool holder and the outer portion of the central bore of the main guide sleeve may have engaging surfaces arranged in configurations other than the preferred square arrangement above-described. For instance, the planar surfaces of tool holder and outer portion of the central bore may be arranged to have any closed polygon configurations, such as triangular, hexagonal, octagonal and the like. Similar to the preferred squared arrangement, these other closed polygon configurations also increase the surface area of engagement in a manner that more effectively distributes machining loads. Thus, machining accuracy is maintained and the life of the profiler's components and the tool are extended.

As best illustrated in FIGS. 1, a lubricating felt gasket 119 may be employed to provide a supply of lubricant to the linear drive mechanism 14 and to retain some of the lubricant in the linear drive mechanism 14. More specifically, the gasket 119 may be retained in an annular recess 121 contiguously formed in the outer portion 86 of the central bore 79 in the main guide sleeve 60. The recess 121 is adapted to receive most of the gasket 119 with only a slight portion of it protruding beyond the inner surfaces 88*a*, 88*b*, 88*c* and 88*d* into the central bore 79 where it is engaged tightly with the outer surfaces 136*a*, 136*b*, 136*c* and 136*d* of the tool holder 16. Due to the slight tolerances between the tool holder 16 and the outer portion 86 of the central bore 79, the outer surfaces 136*a*, 136*b*, 136*c* and 136*d* of the tool holder 16 slide against the gasket 119 to squeeze lubricant from the gasket 119. To maintain a supply of lubrication, the gasket 119 may be moistened periodically, such as every 2 to 5 hours of machine operation, with a light high temperature lubricant. To moisten the gasket 119, the tool holder cover 126 and the tool holder 16 may be moved to access the gasket 119.

As best illustrated in FIGS. 2, 3 and 5, adjacent surfaces of the outer surfaces 136*a*, 136*b*, 136*c* and 136 of the tool holder 16 meet along very slightly rounded edges 138 (FIGS. 3 and 5). Similarly, adjacent surfaces of the inner surfaces 88*a*, 88*b*, 88*c* and 88*d* defining the outer portion 86 of the central bore 79 of the main guide sleeve 60 also meet along slightly rounded edges 140 (FIGS. 2 and 3). These rounded edges 138 and 140 facilitate manufacturing of the outer portion 86 of the central bore 79.

As best illustrated in FIGS. 2 and 5, four peripheral end edges 144 (FIG. 2) outline the outer end perimeter of the surfaces 88*a*, 88*b*, 88*c* and 88*d* defining the outer portion 86 of the central bore 79. The edges 144 may be chamfered inward toward the outer portion 86 of the central bore 79 in the main guide sleeve 60 with a predetermined slope. Similarly, four peripheral end edges 142 (FIG. 5) outline the outer end perimeter of the outer surfaces 136*a*, 136*b*, 136*c* and 136*d* of the tool holder 16. The edges 142 may be chamfered outward from the bore 116 (FIG. 5) of the tool holder 16 with a predetermined slope. For instance, the predetermined slope may be approximately 45 degrees for both the edges 144 and 142. The chamfered edges 142 and 144 aid in inserting the square end 125 of the tool holder 16 into the outer portion 86 of the central bore 79 in the main guide sleeve 60.

The outer portion 86 of the central bore 79 in the main guide sleeve 60 has a predetermined longitudinal length sufficient to allow the tool holder 16 to reciprocate a desired distance. The predetermined longitudinal length of the outer portion 86 is coordinated with the length of the tool holder 16. For instance, a main guide sleeve that is approximately 50 millimeters (mm.) may have its central cavity 79 longitudinally segmented to have an inner portion 82 having a length of approximately 28 mm. and an outer portion 86 having a length of approximately 22 mm. The above-mentioned dimensions are appropriate for supporting and guiding a tool holder having an overall length of approximately 23.5 mm., which includes an outer square surface that may have a length in the range of about 9 to 12.5 mm.

Further in accordance with the above-mentioned dimensions, the inner portion 82 of the central bore 79 may have a diameter in the range of about 9.75 mm. to 9.85 mm. for placing the inner circular surface 84 in a sliding engagement with the outer surface 92 of the reciprocating sleeve 90, which may have an outside diameter in the range of about 9.6 mm. to 9.7 mm.

Even further in accordance with the above-mentioned dimensions, the inner surfaces 88*a*, 88*b*, 88*c* and 88*d*, defining the outer portion 86 of the central bore 79 in the main guide sleeve 60, may each have a width of approximately 12 mm. The outer surfaces 136*a*, 136*b*, 136*c* and 136*d* of the tool holder 16 may each have a width of approximately 11.95 mm.

Finally in accordance with the above-mentioned dimensions, the longitudinal edges 140 (FIG. 3) between adjacent surfaces of the inner surfaces 88*a*, 88*b*, 88*c* and 88*d* of the outer portion 86 of the central bore 79 may be rounded slightly with an approximate theoretical diameter of 15 mm. The longitudinal edges 138 (FIG. 3) between adjacent surfaces of the outer surfaces 136*a*, 136*b*, 136*c* and 136*d* of the tool holder 16 may be rounded slightly with an approximate theoretical diameter of 14.75 mm.

To further reduce frictional wear of the components of the linear drive mechanism 14, the reciprocating sleeve 90, the main sleeve guide 60 and the tool holder 16 may be made of material having a particular hardness and self-lubricating characteristic to reduce the wear from the slidingly engaged surfaces between such components during machining operations.

For instance, the reciprocating sleeve 90 may be made of an oil hardened steel, such as that generally referred to as "O-6", with an approximate hardness of Rockwell 60–62 to provide effective sliding action with low surface wear. The main sleeve guide 60 may also be made of an oil hardened steel, such as that generally referred to as "O-6", with an approximate hardness of Rockwell 58–60 and which may also be nitrided to an approximate hardness of Rockwell 70. The tool holder 16 may be made of steel, such as one generally referred to as "D-2", having an approximate hardness of Rockwell 56–58. Any other materials having similar characteristics may also be employed and are contemplated by the present invention.

As best illustrated in FIG. 1, in operation, the external source (not shown), through the drive cable (not shown) connected to the lower 24 of the housing 12, drives the drive shaft 20 for operating the rotary drive mechanism 18. The drive shaft 20 rotates in its bearings 26 to rotate the outer and inner plugs 30 and 36, respectively, of the stroke tuner mechanism 28. As a result, the stroke tuner shaft 40 rotates off-center relative to the axis "A" of rotation for the drive shaft 20. The connecting rod 46 follows this off-center rotation to convert the rotational movement of the rotary drive mechanism 18 into linear movement for the linear drive mechanism 14.

The connecting rod 46 is mounted to the stroke tuner shaft 40 to the linear drive mechanism 14 attaching to the reciprocating sleeve 90 at its inner end 94 with the spherical ball 108 located between the first and second partially spherical sockets 104 and 110. The connecting rod 46 reciprocates the reciprocating sleeve 90 in a linear direction normal to the axis "A" while swiveling on its ball 108.

The main guide sleeve 60 guides the linear reciprocating movement of the reciprocating sleeve 90 with its inner surface 84, that defines the inner portion 82 of the central bore 79, engaging the outer surface of 92 of the reciprocating sleeve 90.

The outer end 96 of the reciprocating sleeve 90 is attached to the tool holder 16 for driving the tool holder 16 with the reciprocating sleeve 90. The tool holder 16 maintains a tool in its outer tool holding bore 122 which reciprocates with the tool holder 16. The tool holder 16 is guided and supported by the guide engagement above-described between the outer surfaces 136*a*, 136*b*, 136*c* and 136*d* of the tool holder 16 and the inner surfaces 88*a*, 88*b*, 88*c* and 88*d* defining the outer portion 86 of the central bore 79. This square surface engagement, providing four-sided support and greater surface contact area between the tool holder 16 and the main guide sleeve compensates for machining loads from all directions to effectively support and guide the tool holder 16 and to prevent wobbling of the tool holder 16, which aids in maintaining precision machining and in prolonging the life of the profiler and the tool.

It will be understood that various changes in the details, materials and arrangement of parts and systems which have been herein described and illustrated in order to explain the nature of the invention may be made by those skilled in the art within the principle and scope of the invention as expressed in the appended claims.

What is claimed is:

1. A hand-held reciprocating device for driving a tool in a substantially linear path comprising:

a housing having an internal cavity and a first bore extending out of the housing and communicating with the cavity;

a drive mechanism located in the cavity of the housing for providing reciprocating movement;

an outer guide sleeve having an inner end mounted against longitudinal movement to the housing, an outer end opposite the inner end, and a second bore being aligned with the first bore and extending between the inner end and the outer end, the second bore having a plurality of contiguous, inner guide surfaces defining the second bore at the outer end of the guide sleeve;

an inner reciprocating sleeve located intermediate the inner end and outer end in the second bore of the outer guide sleeve for movement in the outer guide sleeve, the inner reciprocating sleeve having a first end coupled to the drive mechanism and a second end located adjacent the outer end of the outer guide sleeve;

a connector extending from the cavity through the first bore for coupling the first end of the inner reciprocating sleeve to the drive mechanism; and a tool holder being capable of holding the tool and being coupled to the second end of the inner reciprocating sleeve for substantially linear reciprocating movement with the inner reciprocating sleeve, the tool holder having a plurality of contiguous, outer engagement surfaces, each of the contiguous engagement surfaces disposed to slidingly engage a corresponding contiguous guide surface of the outer guide sleeve to guide the substantially linear reciprocating movement of the tool holder.

2. A hand-held reciprocating device in accordance with claim 1 wherein the second bore of the outer guide sleeve has larger transverse cross-sectional area at its outer end than at its inner end.

3. A hand-held reciprocating device in accordance with claim 1 wherein the contiguous outer engagement surfaces on the tool holder are substantially planar surfaces and the contiguous guide surfaces defining the second bore at the outer end of the outer guide sleeve are substantially planar surfaces, each of the substantially planar engagement surfaces of the tool holder disposed to slidably engage a corresponding substantially planar guide surface of the guide sleeve.

4. A hand-held reciprocating device in accordance with claim 3 wherein the intersection of the planar surfaces of the tool holder and the outer guide sleeve are rounded slightly.

5. A hand-held reciprocating device in accordance with claim 3 wherein at least two adjacent engagement surfaces of the tool holder are substantially perpendicular to one another; at least two corresponding adjacent guide surfaces guide sleeve at the outer end are substantially perpendicular to one another; and the substantially perpendicular engagement surfaces are disposed to slidably engage the substantially perpendicular guide surfaces.

6. A hand-held reciprocating device in accordance with claim 5 wherein the outer guide sleeve is made of a metal material capable of self-lubricating for being resistant to wear.

7. A hand-held reciprocating device in accordance with claim 6 wherein the outer guide sleeve is made from an oil hardened metal material with an approximate hardness of at least Rockwell 58–60.

8. A hand-held reciprocating device in accordance with claim 7 wherein the metal material is nitrided to have an approximate hardness of at least Rockwell 70.

9. A hand-held reciprocating device in accordance with claim 5 wherein the tool holder is made from metal material with an approximate hardness of at least Rockwell 56–58.

10. A hand-held reciprocating device in accordance with claim 5 wherein the inner reciprocating sleeve is made from an oil hardened metal material with an approximate hardness of at least Rockwell 60–62.

11. The hand-held reciprocating device of claim 1, wherein each of the guide surfaces are substantially planer, the guide surfaces forming a first angle at each intersection of the guide surfaces; and each of the engagement surfaces are substantially planer, engagement surfaces forming a second angle corresponding to the first angle at each intersection of engagement surfaces.

12. A hand-held reciprocating device for driving a tool in a substantially linear reciprocating path comprising:

a rotary drive mechanism having a main drive shaft rotating about an axis of rotation;

a tuner mounted upon the drive shaft to be driven by the rotary drive and having a connecting rod following the tuner for converting rotary motion to linear motion perpendicular to the axis of rotation for the drive shaft;

a linear drive mechanism coupled to the connecting rod and comprising a main guide sleeve defining a central bore and a square socket, the square socket communicating with the central bore, a reciprocating sleeve located in the central bore and having a first end connected to the connecting rod for being reciprocated in a substantially linear direction in the bore of the main guide sleeve and a second end extending into the square socket; and a tool holder being coupled to the second end of the reciprocating sleeve for substantially linear reciprocating movement with the reciprocating sleeve and having a tool attachment end and an opposing square end, the tool attachment adapted to secure the tool for movement with the tool holder, the square end being coupled to the second end of the reciprocating sleeve and being slidably received in the square socket of the main guide sleeve for providing substantially linear movement to tool holder.

13. A hand-held reciprocating device in accordance with claim 12 wherein the square end of the tool holder further comprises a bore adapted to frictionally receive the second end of the reciprocating sleeve so that the tool holder reciprocates with the reciprocating sleeve.

14. A hand-held reciprocating device in accordance with claim 12 further comprising a tool holder cover mounted to the tool holder for movement with the tool holder.

15. A hand-held reciprocating device in accordance with claim 14 wherein the tool holder cover frictionally engages the tool holder so the cover moves with the tool holder.

16. A hand-held reciprocating device in accordance with claim 15 wherein the tool holder cover frictionally engages the main guide sleeve for movement relative to the main guide sleeve.

17. A hand-held reciprocating device in accordance with claim 12 wherein the main guide sleeve is made of a metal material capable of self-lubricating for being resistant to wear.

18. A hand-held reciprocating device in accordance with claim 17 wherein the main guide sleeve is made from an oil hardened metal material with an approximate hardness of at least Rockwell 58–60.

19. A hand-held reciprocating device in accordance with claim 18 wherein the metal material is nitrided to have an approximate hardness of at least Rockwell 70.

20. A hand-held reciprocating device in accordance with claim 12 wherein the tool holder is made from a metal material with an approximate hardness of at least Rockwell 56–58.

21. A hand-held reciprocating device in accordance with claim 12 wherein the reciprocating sleeve is made an oil hardened metal material with an approximate hardness of at least Rockwell 60–62.

* * * * *